US006406569B1

(12) United States Patent
Moser et al.

(10) Patent No.: US 6,406,569 B1
(45) **Date of Patent: *Jun. 18, 2002**

(54) PROCEDURE FOR THE THERMAL TREATMENT OF RAILS

(75) Inventors: Alfred Moser; Georg Prskawetz; Peter Pointner, all of Leoben (AT)

(73) Assignee: Voest-Alpine Schienen GmbH, Leoben (AT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 1283 days.

(21) Appl. No.: 08/533,944

(22) PCT Filed: Jul. 9, 1993

(86) PCT No.: PCT/AT93/00116

§ 371 (c)(1),
(2), (4) Date: May 10, 1994

(87) PCT Pub. No.: WO94/02652

PCT Pub. Date: Feb. 3, 1994

Related U.S. Application Data

(63) Continuation of application No. 08/196,183, filed on May 10, 1994, now abandoned.

(30) Foreign Application Priority Data

Jul. 15, 1992 (AT) ..... 1455/92

(51) Int. Cl.[7] ..... C21D 9/04
(52) U.S. Cl. ..... 148/582
(58) Field of Search ..... 148/581, 582

(56) References Cited

FOREIGN PATENT DOCUMENTS

| | | | | |
|---|---|---|---|---|
| CA | 1205729 | * | 6/1986 | 148/582 |
| DE | 582957 | | 8/1933 | |
| EP | 49004 | | 4/1982 | |
| EP | 88746 | | 9/1983 | |
| EP | 358362 | | 3/1990 | |
| JP | 55-2768 | * | 1/1980 | 148/581 |
| JP | 1-290717 | * | 11/1989 | 148/582 |

* cited by examiner

*Primary Examiner*—Sikyin Ip
(74) *Attorney, Agent, or Firm*—Greenblum & Bernstein, P.L.C.

(57) ABSTRACT

A method for the thermal treatment of rails, in particular of the rail head, in which cooling is carried out in a cooling agent that contains a synthetic cooling agent additive, starting at temperatures above 720° C. The treatment is carried out by immersion in the cooling agent until withdrawl of the immersed areas, courses, at a surface temperature between 450 and 550° C. results without temperature equalization across the whole of the cross-section, section, there by avoiding hardening of the rail web whilst maintaining an optimal cooling rate for the rail head.

5 Claims, 2 Drawing Sheets

PROCEDURE FOR THE THERMAL TREATMENT OF RAILS

This is a continuation of application Ser. No. 08/196,183, filed on May 10, 1994, now abandoned, which was abandoned upon the filing hereof.

BACKGROUND OF THE INVENTION

1. Field of the Invention

The present invention relates to a procedure for the thermal treatment of rails, in particular of the rail head in which, proceeding from temperatures above 720° C., cooling is carried out in a cooling agent that contains an additive of synthetic cooling agent.

2. Related Art

A procedure of the type described above is known, for example, from EP-PS 88 746. This known procedure uses synthetic cooling agent additives amounting to 20 to 50%-wt, in particular polyglycols, the additive of synthetic cooling agent ensuring, in the first place, averaging [homogenization] of the cooling conditions whilst maintaining a reduced cooling rate. Usually, synthetic quenching agents are used in the technology where it is necessary to maintain a minimal cooling rate in order to obtain a martensite structure. The objective of hardening of this kind is to harden the maximal cross-section and, in the case of objects that are of varying cross-sections, the areas of smaller cross-section will also be completely hardened. In applications of this type, the work piece can be left in the bath or hardening bath until temperature equalization takes place.

In the event that a synthetic quenching agent is used in conjunction with the thermal treatment of rails, any hardening of the rail web is undesirable. Furthermore, the objective is to achieve a finely pearlitized structure and the maintenance of a maximal cooling rate is required during fine pearlitizing of this kind. If, however, as in the known procedure, the optimal cooling rate that permits a fine pearlite structure without martensite or pearlite were to be used in the rail head, this would mean that the cooling rate for the essentially thinner rail web would be much too high.

SUMMARY OF THE INVENTION

Thus, it is the task of the present invention to create a procedure of the type described in the introduction hereto, with which the optimal cooling rates for the rail head can be maintained and, at the same time, any undesirable hardening of the essentially thinner web can be prevented. In order to solve this problem, the procedure according to the present invention is essentially such that treatment by immersion in the cooling agent is continued until such time as the surface temperature is between 450° C. and 550° C., without the temperature being equalized across the whole of the cross-section, after the removal of the immersed areas.

Because of the fact that removal takes place at a time at which the immersed areas have reached a surface temperature between 450 and 550° C. without temperature equalization across the whole of the cross-section, it is ensured that removal is early enough to prevent the formation of a hardness structure within the web. Were one to wait for temperature equalization there would, undoubtedly, be an undesirable hardening within the web; in this connection, the step taken according to the present invention, whereby a surface temperature of 450 and 550° C. is a criterion for the timeliness of the removal, this, in conjunction with the fact that a synthetic cooling agent additive is used, means that the cooling rate within the head is low enough to prevent any hardening within the web. At the same time, however, although the use of a synthetic cooling agent additive leads to a reduction of the cooling rate, it also ensures a cooling rate that is sufficiently high to ensure the formation of an extremely strong fine-perlitic structure within the rail head. In this connection, it is advantageous that the procedure according to the present invention be so carried out that synthetic additives such as, for example, glycols or polyglycols, are added to the cooling agent in a quantity that, at a bath temperature between 35 and 55° C., the transition from film boiling to the boiling phase takes place at a surface temperature of approximately 500° C., which thereby indicates the desired timepoint for removing the rails. In particular, the use of synthetic additives, preferably of glycols and polyglycols, in a quantity that ensures that the correct timepoint for the contraction of the rails is indicated by the bath boiling ensures that constant and optimal results are guaranteed both for the rail head and for the web. If, given an appropriate selection of the proportions of synthetic additives, boiling begins on the surface of the rails, the lower areas will certainly not yet have been converted into pearlite. Compared to cooling in a bath without synthetic cooling agent additives there is a relatively slower cooling period until the boiling point is reached.

Only after the boiling phase has been reached does the cooling rate increase rapidly; thus, the boiling point signals a relatively characteristic limit for the transition from relatively slower to relatively quicker cooling within the bath. Once the boiling point has been reached, or shortly thereafter, the work piece has to be removed if excessively rapid cooling is to be avoided, and adjustment of the film boiling in such a way that the head area of the rails permits optimal pearlite formation down to a depth of approximately 20 to 25 mm, leads, after removal, to the fact that the deeper areas are still converted into pearlite; in contrast to this, were the work pieces to be left in the bath after film boiling begins, martensite would be formed because of the more rapid cooling that would take place. Once the boiling point has been reached, cooling can be continued outside the bath slowly enough to ensure complete formation of pearlite which, as has been discussed above, would not be ensured once the boiling point has been reached because of the significantly quicker cooling within the bath. Furthermore, rapid cooling rates of this kind in the bath also result in the fact that the smaller web cross-section would be hardened more rapidly and there would still be an undesirable formation of martensite, which would naturally increase the risk of breakage.

Essential for the procedure according to the present invention is management of the procedure by selection of suitable quantities of synthetic cooling agent within the cooling agent, and precise determination of the time at which the immersed areas must be removed in order to prevent any undesirable hardening of other areas. The proportion of synthetic additives within the cooling agent determines the time of the transition from film boiling to the boiling phase, and the adjustment of the combination must be such that the boiling phase is first reached in the last cooling phase before removal, in order to ensure even cooling. The concentration that is set must be kept steady constantly, by using an appropriate monitoring system, which is not necessary during the usual use of the method according to the prior art; this must be done so as to ensure that this concentration, which is essential for timely identification of the time for removal, is not subjected to any variations in the course of the procedure. This also applies to the bath temperature.

In contrast to the known prior art, bath circulation must be kept constant. With reference to the rate at which the medium flows onto the rolled material or the rails that are to be cooled, in the present case it must be ensured that this is kept as steady as possible over the whole length of the rolled materials or the rails, throughout the whole of the thermal treatment. In the known procedure for hardening, when full immersion is made from the austenitic structural state, it is sufficient to keep to only a lower limit of this parameter in order to maintain the hardening effect. In contrast to this, the procedure according to the present invention relates to a combination of immersion temperature and immersion time that provides an optimal combination for partial immersion, the rails exhibiting a surface temperature between 450 and 550° C. at the end of the cooling period, with no temperature equalization across the whole of the cross section.

During partial submersion of the rails and immersion of the rail head, it is possible to proceed such that the rail foot is cooled with compressed air and/or a water-air mixture. The procedure according to the present invention can be applied advantageously to a steel having a guide analysis of 0.65–0.85% C, 0.01–1.2% Si, 0.5–3.5% Mn, 0.01–1.0% Cr, and the remainder Fe and the usual impurities.

The selection of the correct concentration for the synthetic cooling agent additive and the step that entails effecting the drawing at a defined time, namely the transition from film boiling to the boiling phase, results in each instance in optimal results relative to the structure formation after thermal treatment, even in the case of different rail profiles.

BRIEF DESCRIPTION OF THE DRAWINGS

The present invention will be described in greater detail below on the basis of one embodiment of the procedure according to the present invention; the drawings show greater details with respect to the hardness values that can be achieved using the procedure for thermal treatment according to the present invention.

DESCRIPTION OF THE PREFERRED EMBODIMENT

As an example, the following parameters are observed when carrying out the procedure for the thermal treatment of rails, in particular of the rail head. The rail or the rail head that is at a temperature of 820° C. is immersed in a cooling agent that contains a synthetic cooling agent additive, the immersion depth of the head amounting to approximately 37 mm. Given a bath temperature of 50° C. and a selected bath concentration of 35%, after an immersion time of 150 s the surface temperature is 505° C., this surface temperature being maintained, or the immersed areas being removed at a time when no temperature equalization has taken place across the whole rail or rail head cross-section.

Figure 1:
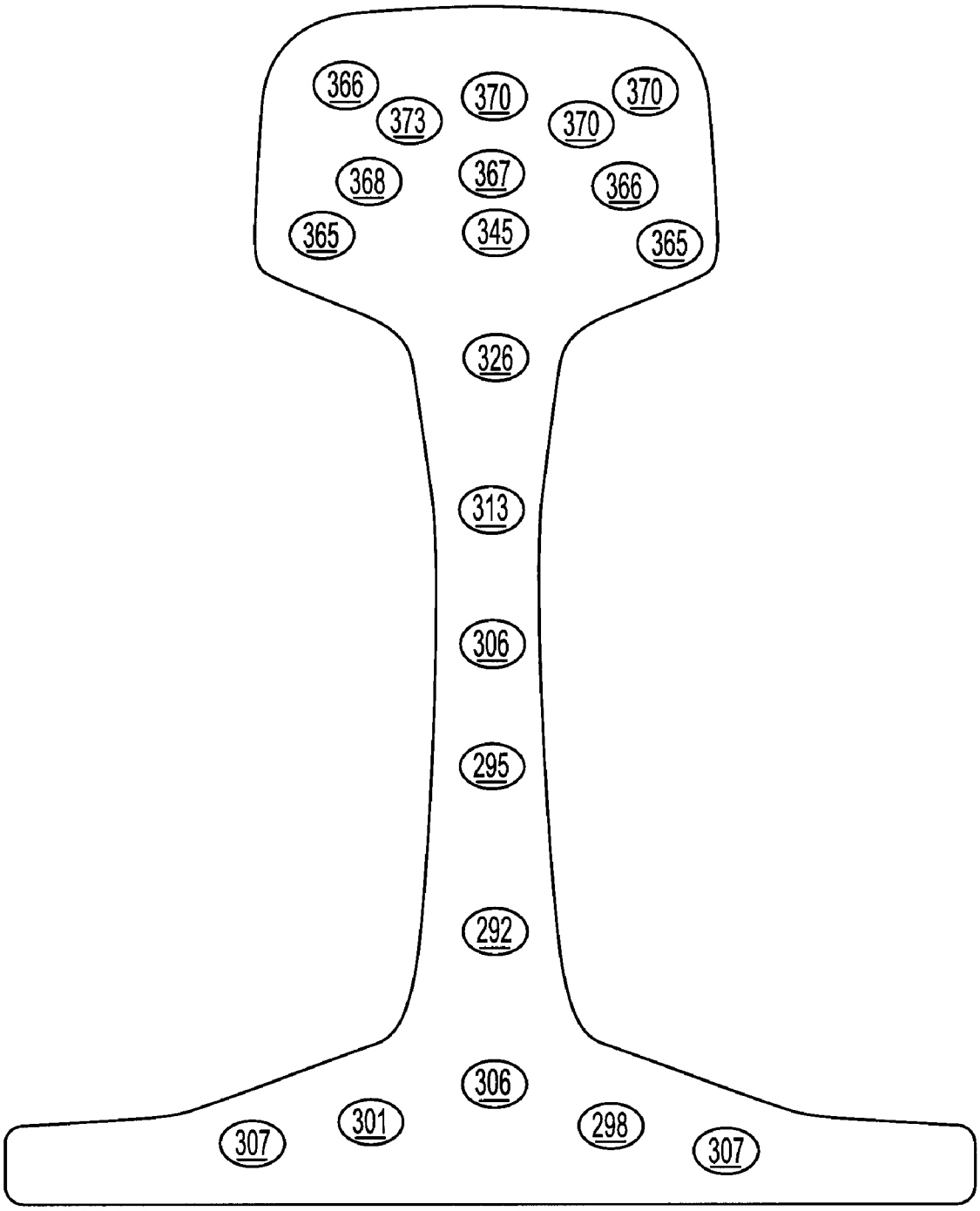
FIG. 1 is a cross-section through a rail treated by the procedure according to the present invention, with the HB hardness distribution being shown for the different zones.

The hardness distribution that can be achieved with a procedure of this kind is shown in FIG. 1 as it applies to a UIC 60 rail profile, the HB hardness distribution being shown for the different areas. It is clear that the rail head displays higher hardness values than the rail web and the rail foot.

Figure 2:
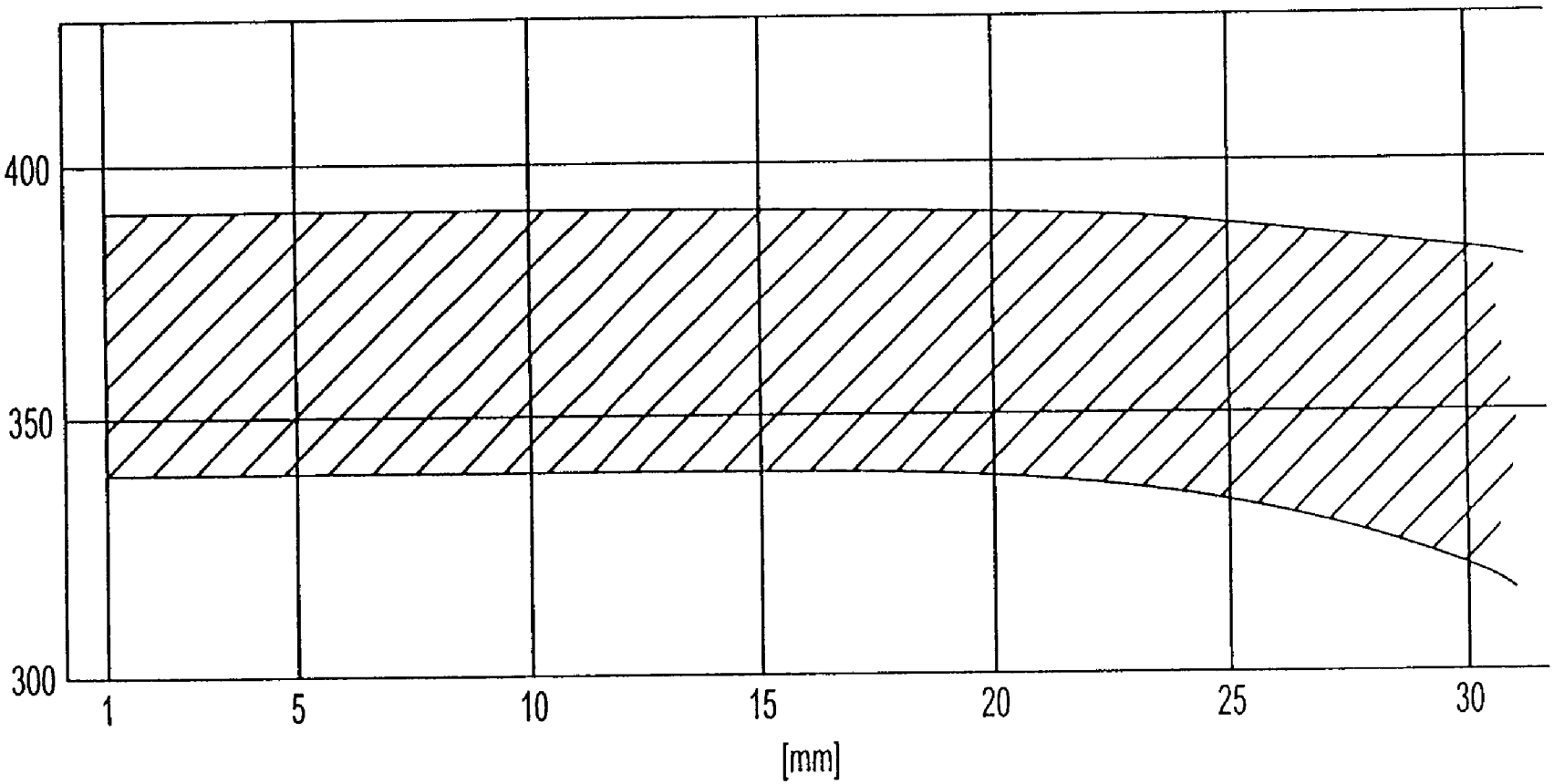
FIG. 2 is a diagram showing hardness distribution as a function of the distance from the middle of the top contact surface towards the rail web.

The diagram shown in FIG. 2, indicates the HB 30 hardness distribution that can be achieved with the procedure for the thermal treatment of rails, as a function of the distance from the middle of the top surface in millimeters.

All in all, it can be seen that because of the fact that the withdrawing of the immersed work piece or of the rail head takes place before the time total cross-sectional temperature equalization is effected, an undesirable hardening of the web is avoided, whereas the rail head displays the desired hardness or hardness distribution.

What is claimed is:

1. A method for the thermal treatment of a rail head of a rail in which cooling is carried out, comprising:

immersing said rail head at an initial temperature of above 720° C. in a cooling agent that contains a synthetic cooling agent additive, and withdrawing said rail head from the cooling agent upon obtaining a surface temperature of said rail head of between 450 and 550° C. without temperature equalization over the entire cross-section of said rail head.

2. A method as set forth in claim 1, wherein the synthetic additive is a glycol or polyglycol included in the cooling agent in a quantity at which a bath temperature of the cooling agent between 35–55° C. has a transition from film boiling to a boiling phase at a temperature between 450 and 550° C. so as to indicate the time when the rail head is withdrawn from the cooling agent.

3. A method as set forth in claim 1 or claim 2, wherein the rail includes a rail foot which is cooled by at least one of compressed air and a water-air mixture.

4. A method as set forth in claim 1 or claim 2, wherein the rail is steel having a guide analysis of 0.65–0.85% C, 0.01–1.2% Si, 0.5–3.5% Mn, 0.01–1.0% Cr, and the rest Fe and impurities.

5. A method as set forth in claim 4, wherein the rail includes a rail foot which is cooled by at least one of compressed air and a water-air mixture.

* * * * *

UNITED STATES PATENT AND TRADEMARK OFFICE

CERTIFICATE OF CORRECTION

PATENT NO. : 6,406,569 B1
DATED : June 18, 2002
INVENTOR(S) : A. Moser et al.

It is certified that error appears in the above-identified patent and that said Letters Patent is hereby corrected as shown below:

Title page,
Item [22], "PCT Filed: Jul. 9, 1993" should be -- Filed: September 26, 1995 --.
Delete Item "[86], PCT No.: PCT/AT93/00116".
Delete Item "[86], §371 (c)(1), (2), (4) Date: May 10, 1994".
Delete Item "[87], PCT Pub. No.: WO94/02652".
Delete Item "[87], PCT Pub. Date: Feb. 3, 1994".
Item [63], Related U.S. Application Data, after "abandoned" insert -- , which is a U.S. National Stage of International Application. No. PCT/AT93/00116, filed July 9, 1993 --.

Column 1,
Line 5, "May 10, 1994" should be -- July 9, 1993 --.
Line 6, after "hereof" insert -- , which is a U.S. National Stage of International Application No. PCT/AT93/00116 filed July 9, 1993 --.

Signed and Sealed this

Twelfth Day of August, 2003

JAMES E. ROGAN
*Director of the United States Patent and Trademark Office*